US005647490A

United States Patent [19]

Hull et al.

[11] Patent Number: 5,647,490

[45] Date of Patent: Jul. 15, 1997

[54] SHELF AND CLOTHES HANGER POLE SUPPORT BRACKET

[76] Inventors: Harold L. Hull, 451 Canyon Way #43, Sparks, Nev. 89434; Stanley D. Harmon, 800 Polland Rd. Ste. 4A, Los Gatos, Calif. 95030

[21] Appl. No.: 330,561

[22] Filed: Oct. 28, 1994

[51] Int. Cl.[6] ..... A47F 5/00

[52] U.S. Cl. ..... 211/90.01; 108/29; 211/105.1

[58] Field of Search ..... 211/90, 105.1, 211/123; 108/29

[56] References Cited

U.S. PATENT DOCUMENTS

| | | | |
|---|---|---|---|
| 2,859,879 | 11/1958 | Rogers et al. | 211/90 |
| 2,908,471 | 10/1959 | Hollansworth | 211/105.1 X |
| 3,113,678 | 12/1963 | Dickinson | 211/90 |
| 3,239,070 | 3/1966 | Clauson | 211/105.1 |
| 3,247,973 | 4/1966 | Ruhnke | 211/105.1 |
| 3,669,395 | 6/1972 | Gehrke | 211/90 X |
| 3,702,591 | 11/1972 | Banse | 211/90 X |
| 3,987,904 | 10/1976 | Height et al. | 211/105.1 |
| 5,310,148 | 5/1994 | Dorr | 248/223.4 |
| 5,350,072 | 9/1994 | Rogers et al. | 211/123 |

*Primary Examiner*—Robert W. Gibson, Jr.

[57] ABSTRACT

Disclosed herein we provide a bracket for supporting a clothes hanger pole and shelf, with the bracket including two integrally formed members. The bracket as designed allows a hanger when slidably engaged about the hanger pole to slide along the entire length of the pole without any obstruction from the bracket, unlike that of prior art. Furthermore, the present bracket is economical, easy to manufacture, eliminates unnecessary parts and may be made from various materials and well as may be produced in a variety of colors.

7 Claims, 2 Drawing Sheets

SHELF AND CLOTHES HANGER POLE SUPPORT BRACKET

FIELD OF THE INVENTION

This invention relates to brackets but more specifically relates to a bracket used to support a shelf and clothes hanger pole.

BACKGROUND OF THE INVENTION

It is well known by anyone having a closet, closet shelf and clothes hanger pole that when it is desirable to slide a hanger along the support pole from one end to the other, the support bracket tends to obstruct the hanger and therefore causes the user to unnecessarily remove the hanger therefrom and re-position thereon at a location of choice.

A second drawback of the cited prior art is the fact that none of these brackets are universal, as each have different designs and functions.

Still another impediment inherent in the prior art is the fact that each bracket is not cost efficient to manufacture and still further, each include multiple parts.

The prior art is very limited and each prior art reference teaches a support bracket having the above inherent impediments, such as U.S. Pat. No. 5,310,148, filed on May 10, 1994 by Dorr and U.S. Pat. No. 3,113,678, filed on Dec. 26, 1962, by Dickinson, each of which teach a hook shaped support bracket which is cumbersome as well as obstructive.

Nowhere in the prior art (known to the applicants) do they teach a shelf and clothes hanger pole support bracket which addresses and overcomes the afore mentioned inherent impediments.

It is therefore contended by the applicants that a need exists for a bracket which supports a clothes hanger pole and shelf in a secure manner, yet allows a typical clothes hanger (when positioned thereon) to easily slide along the entire length of the pole without any obstructions. It is further contended by the applicants that such a support bracket should be integrally formed, universally versatile and further eliminates unnecessary parts.

SUMMARY OF THE INVENTION

It is therefore a primary object of the present invention to provide a clothes hanger pole and shelf support bracket which does not obstruct or hinder sliding a hanger along the entire length of a clothes hanger pole when positioned thereon.

A further object is to provide a bracket which comprises only two members, each of which may be formed from a blank, pierce and form die, (if made from metal, which is the preferred embodiment,) however, the bracket may be made from a variety of materials, such as wood, hard plastic, even nylon etc. and further may be produced in various colors.

Another object is to provide a bracket which supports a clothes hanger pole and shelf.

Yet another object is to provide a support bracket which is of a unique shape and design.

Still another object is to provide a bracket which is removably attachable to a wall and a clothes hanger pole.

Still another object is to provide a method of use and/or installation for at least a first and second bracket, which in combination provide support for a clothes hanger pole and shelf, with each bracket having the following; a wall attachment means, a clothes hanger pole attachment means, a desired location and a shelf supporting surface, with the brackets cooperating with a clothes hanger pole, a wall, a shelf and a user having decided a desired location for the brackets, comprising the steps of;

a. drilling vertical bores within the hanger pole at the users desired locations, with the locations being aligned with the brackets desired location;

b. positioning a first bracket at the brackets desired location;

c. attaching the first bracket to a wall by using the brackets attachment means;

d. positioning at least a second bracket at the brackets desired location;

e. repeating step (d) with the second bracket;

f. positioning the clothes hanger pole having drilled bores upon the brackets clothes hanger pole attachment means;

g. attaching the hanger to the brackets by using the clothes hanger pole attachment means and h. positioning a shelf upon the shelf supporting surface of the brackets.

It is to be noted that the above method of use is only exemplary of one installation method, however it is to be known that installation variants from the method as herein disclosed may be applicable and that the present invention is not to be limited in any way to the method as herein presented.

Still another object is to provide a bracket which is inexpensive and easy to manufacture.

Yet another object is overcome the inherent drawbacks and impediments of known prior art brackets and/or devices.

Other objects and advantages will become apparent when taken into consideration with the following drawings and specification.

DETAILED DESCRIPTION OF THE DRAWINGS

Referring now in detail to the drawings wherein like characters refer to like elements throughout the various views.

Figure 1:
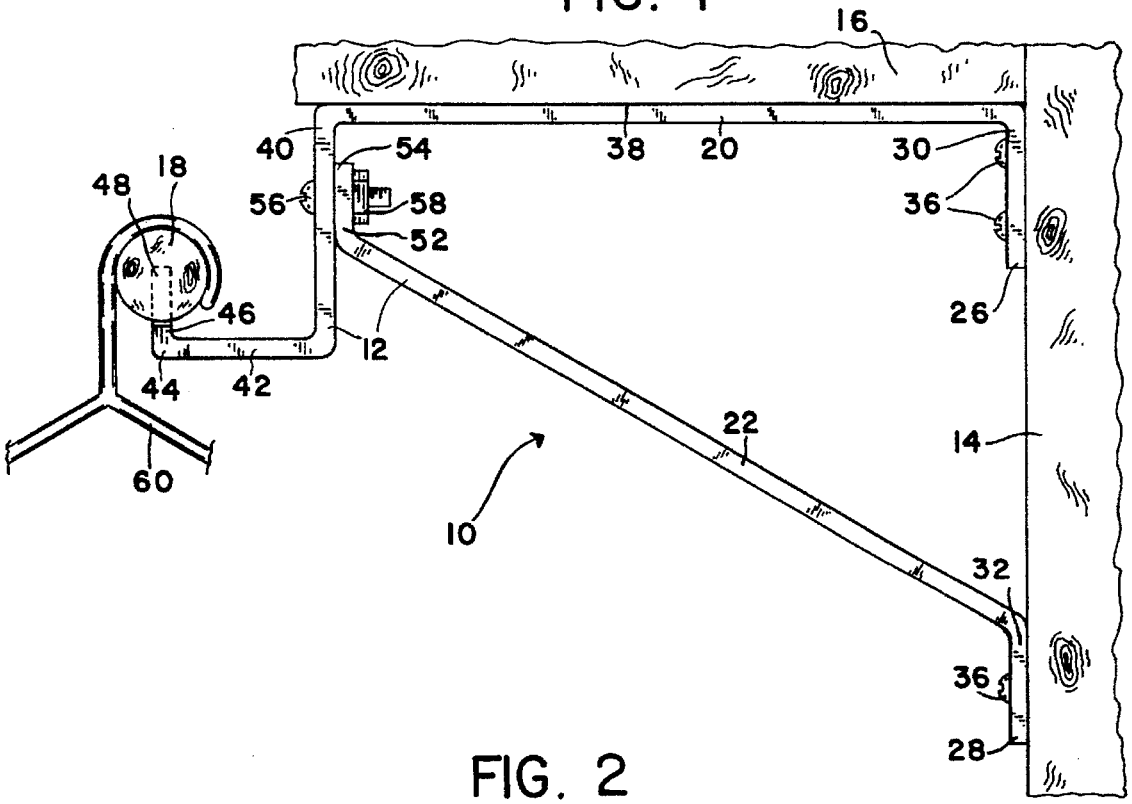
FIG. 1, is a side elevational view of a support bracket when attached to a wall, a support shelf and a clothes hanger pole.

Shown in FIG. 1, 10 represents an overview of the present invention which shows a support bracket 12 being removably attached to a wall 14 while also supporting a shelf 16 and a hanger pole 18.

Figure 3:
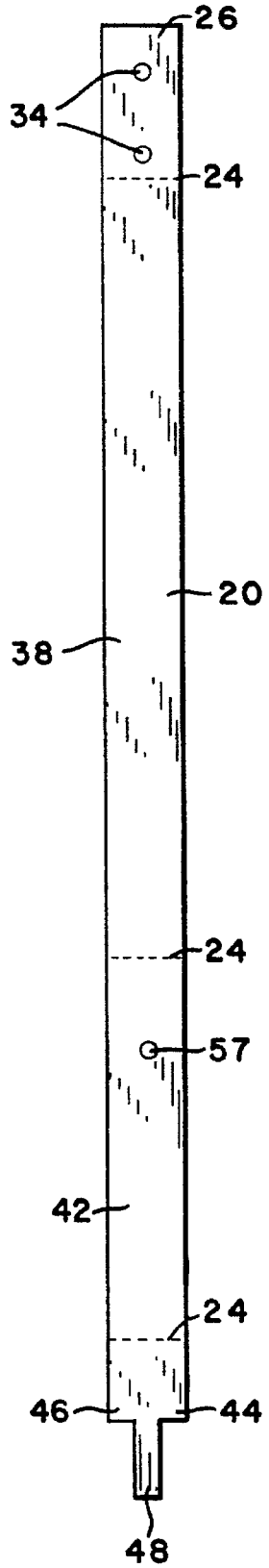
FIG. 3, is a top view of a first member of the support bracket, shown with bend lines before being bent.
Figure 4:
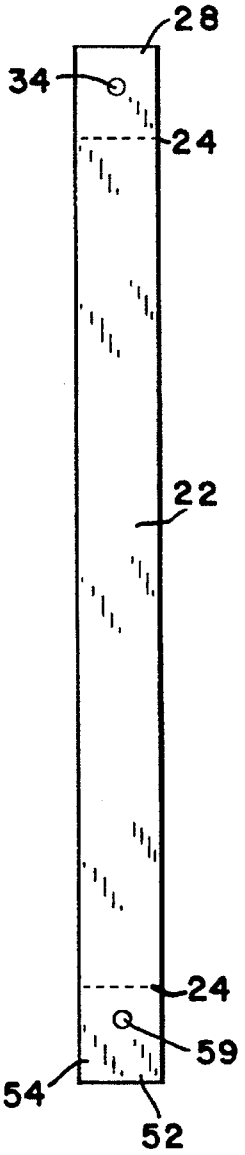
FIG. 4, is a top view of a second member of the support bracket, shown with bend lines before being bent.

Bracket 12 may be made from a variety of materials, such as hard plastic, nylon, wood, ect., and if so desired, each of which may be produced in a variety of colors. However, as we have shown in the preferred embodiment, metal is the most advantageous as well as cost efficient. The bracket 12 is formed from a first substantially elongated integrally formed member 20 and a second substantially elongated integrally formed member 22. Each member may be manufactured from an integrally formed blank, pierce and form die, as clearly shown in FIGS. 3 and 4. As further shown therein, members 20 and 22 (after manufacture) may be shaped and formed, such as by fold lines 24.

Figure 2:
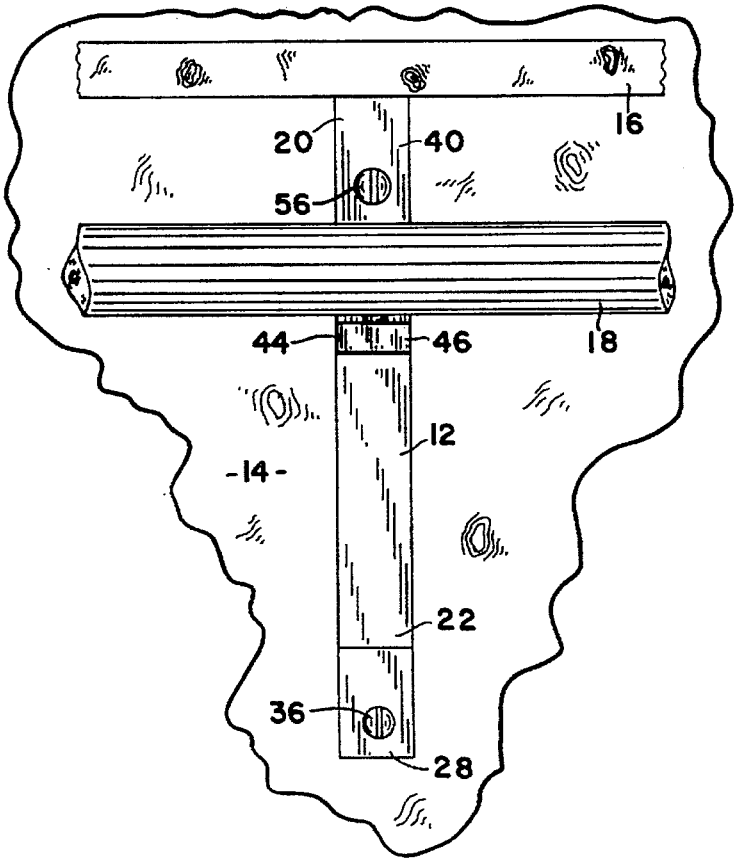
FIG. 2, is a front elevational view thereof.

Members 20 and 22 each have a first end, 26 and 28. Each end being bent to form vertical wall engaging legs 30 and 32 and each leg including suitable means to be removably affixed to wall 14, such as by holes 34 (holes shown in FIGS. 3 & 4) which are of a shape and size to accept a screw 36 (when positioned therein), as shown in FIGS. 1 and 2.

Figure 5:
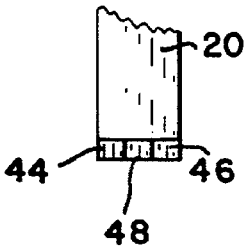
FIG. 5, is a partial elevational top view of an elongated protrusion attachable to a clothes hanger pole.

The first member 20 further including the following; a shelf supporting surface 38, a first portion 40, a second portion 42 and a second end 44. The surface 38 being of a shape and size to support shelf 16 while the first portion 40 being bent to form substantially a 90 degree downwardly facing vertical leg with the second portion 42 being bent to form substantially a 90 degree horizontal leg which faces outwardly and away from the first end 26, the second end 44 being bent to form substantially a 90 degree upwardly facing vertical extension 46 with its edges being partially cut-away, whereby, forming substantially an elongated protrusion 48, as clearly shown in FIGS. 3 and 5. Furthermore, protrusion 48 being of a size and shape to be removably inserted into a drilled bore (not shown) which is located within the clothes hanger pole at a position of users choice.

The second member 22 further having a second end 52 which is bent to form substantially a vertical upwardly facing attachment leg 54. Leg 54 having suitable means to be removably affixed to the first portion 40 of the first member 20, such as by a threaded bolt 56 which is inserted into the bore 57 (which is located on the first portion 40 of member 20) through a bore 59 in leg 54 and is held in a secure manner by nut 58.

Therefore, bracket 12 is now removably affixed to wall 14 with the bracket 12 supporting shelf 16 and hanger pole 18 in a secure manner, whereby, a typical hanger 60 may now be positioned and slidably engaged about the clothes hanger pole 18 and therefore the hanger 60 is allowed to slide along the entire length of the clothes hanger pole 18 without any obstruction from bracket 12.

It will now be seen that we have provided hanger pole and shelf support bracket which does not obstruct or hinder sliding a hanger along the entire length of a hanger pole when positioned thereon.

It will further be seen that we have provided a support bracket which comprises two members, with each member being integrally formed, if made from metal.

It will further be seen that we have provided a support bracket which may be made from a variety of materials.

It will also be seen that we have provided a bracket which is of a unique shape and design.

It will further be seen that we have provided a bracket which is removably attachable to a wall.

It is still further seen that we have provided a method of use and/or installation for a bracket used for support of a hanger pole and shelf.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatuses.

Having described our invention, what we claim as new and wish to secure by letters patent is:

1. A clothes hanger pole and shelf support bracket attachable to a wall comprising; first and second substantially elongated integrally formed members, said members each having first ends, said first ends being bent to form a vertical wall engaging leg, each said leg including means to be removably affixed to said wall, said first member comprising; a shelf supporting surface, a first portion, a second portion and a second end, said surface being of a shape and size to support said shelf, said first portion attached to said surface and being bent to form substantially a 90 degree downwardly facing vertical leg, said second portion being attached to said first portion and bent to form substantially a 90 degree horizontal leg facing outwardly and away from said first end, said second end being attached to said second portion and bent to form substantially a 90 degree upwardly facing vertical extension, said extension having partially cut-away edges therefore forming substantially an elongated protrusion, said protrusion being of a size and shape to be removably inserted into a bore within said hanger pole, said second member having a second end being bent to form substantially a vertical upwardly facing attachment leg and said attachment leg having means to be removably affixed to said first portion of said first member, whereby;

when a hanger is slidably engaged about said hanger pole, said hanger will slide along the entire length of said pole without any obstruction from said bracket.

2. The support bracket of claim 1 in which each said vertical wall engaging leg includes means to be removably affixed to said wall, said means being at least one hole through said wall engaging leg and said hole being of a size and shape to accept a screw when said screw is inserted therein.

3. The support bracket of claim 1 in which said attachment leg having means to be removably affixed to said first portion of said first member includes said attachment leg and said first portion each having a bore, a bolt, each of said bores being of a shape and size to accept said bolt when said bolt is inserted there through and said bolt being held in a secure manner by a nut.

4. The support bracket of claim 1 is made from metal.

5. The support bracket of claim 1 is made from wood.

6. The support bracket of claim 1 is made from plastic.

7. A method of use for installation of at least a first and second bracket, said brackets in combination providing support for a clothes hanger pole and shelf, each of said brackets having the following; a wall attachment means, a clothes hanger pole attachment means, a desired location and a shelf supporting surface, with said brackets cooperating with the following; said clothes hanger pole, a wall, a shelf and a user having decided a desired location for said brackets, comprising the steps of;

a. drilling vertical bores within said clothes hanger pole at said users desired location, with said users location being aligned with said brackets desired location;

b. positioning said first bracket at said brackets desired location;

c. attaching said first bracket to said wall by using said brackets attachment means;

d. positioning said second bracket at said brackets desired location;

e. repeating step (d) with said second bracket;

f. positioning said hanger pole having drilled bores upon said brackets clothes hanger pole attachment means;

g. attaching said clothes hanger pole to said brackets by using said clothes hanger pole attachment means and h. positioning said shelf upon said shelf supporting surface of said brackets.

* * * * *